US007342164B2

(12) United States Patent
Nishibori et al.

(10) Patent No.: US 7,342,164 B2
(45) Date of Patent: Mar. 11, 2008

(54) PERFORMANCE APPARATUS AND TONE GENERATION METHOD USING THE PERFORMANCE APPARATUS

(75) Inventors: Yu Nishibori, Hamamatsu (JP); Toshio Iwai, Mitaka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/495,467

(22) Filed: Jul. 28, 2006

(65) Prior Publication Data

US 2007/0022865 A1 Feb. 1, 2007

(30) Foreign Application Priority Data

Jul. 29, 2005 (JP) ..... 2005-221953
Oct. 6, 2005 (JP) ..... 2005-293370

(51) Int. Cl.
*G10H 1/34* (2006.01)

(52) U.S. Cl. ..... 84/464 R

(58) Field of Classification Search ..... 84/601, 84/602, 603, 604, 464 A, 464 R, 744, 745
See application file for complete search history.

(56) References Cited

U.S. PATENT DOCUMENTS

| | | | | |
|---|---|---|---|---|
| 3,562,394 A | | 2/1971 | Keipe | |
| 4,031,800 A | | 6/1977 | Thompson | |
| 4,089,246 A | | 5/1978 | Kooker | |
| 4,123,960 A | * | 11/1978 | Franzmann | 84/644 |
| 4,384,503 A | * | 5/1983 | Gunn | 84/653 |
| 4,422,365 A | | 12/1983 | Iwaki | |
| 5,027,689 A | | 7/1991 | Fujimori | |

(Continued)

FOREIGN PATENT DOCUMENTS

DE 100 42 300 A1 3/2002

(Continued)

OTHER PUBLICATIONS

European Search Report for corresponging European Patent Application No. EP 06015695; mailing date of Feb. 6, 2007; pp. 2-12. References cited in the search report have all been filed previously in the present application.

(Continued)

*Primary Examiner*—Lincoln Donovan
*Assistant Examiner*—Andrew Millikin
(74) *Attorney, Agent, or Firm*—Rossi, Kimms & McDowell LLP

(57) ABSTRACT

Key switches are arranged to form plural rows, and light emitting elements are provided in corresponding relation to the key switches. For each of the rows, any operated key switch is detected, and, on the basis of such detection, the light emitting elements are sequentially illuminated so that an illuminated position reciprocates between the operated key switch and the key switch located at a predetermined position of the row the operated key switch belongs to. In synchronism with illumination of the key switch located at a predetermined position of the row, at least one of tones allocated to the row is generated. When duration of operation of the operated key switch is greater than a predetermined time, the light emitting elements located in a predetermined range may be illuminated in accordance with a predetermined pattern, and an effect may be imparted to a tone corresponding to the operated key switch.

18 Claims, 9 Drawing Sheets

U.S. PATENT DOCUMENTS

| | | | | |
|---|---|---|---|---|
| 5,088,378 | A | 2/1992 | DeLaTorre | |
| 5,247,864 | A | 9/1993 | Konishi | |
| 5,530,898 | A | 6/1996 | Miyake | |
| 5,665,927 | A | 9/1997 | Taki et al. | |
| 5,684,259 | A | 11/1997 | Horii | |
| 5,741,990 | A | 4/1998 | Davies | |
| 5,831,195 | A | 11/1998 | Nakata | |
| 5,908,997 | A | 6/1999 | Arnold et al. | |
| 5,936,180 | A | 8/1999 | Ando | |
| 6,160,213 | A | 12/2000 | Arnold et al. | |
| 6,179,432 | B1 * | 1/2001 | Zhang et al. | 362/84 |
| 6,347,998 | B1 | 2/2002 | Yoshitomi et al. | |
| 6,670,535 | B2 | 12/2003 | Anderson et al. | |
| 2002/0105359 | A1 | 8/2002 | Shimizu et al. | |
| 2002/0134223 | A1 | 9/2002 | Wesley | |
| 2003/0015087 | A1 | 1/2003 | Haken | |
| 2006/0005693 | A1 | 1/2006 | Nishibori et al. | |
| 2006/0236846 | A1 | 10/2006 | Nishibori | |
| 2007/0022865 | A1 | 2/2007 | Nishibori et al. | |
| 2007/0022868 | A1 | 2/2007 | Nishibori et al. | |

FOREIGN PATENT DOCUMENTS

| | | | |
|---|---|---|---|
| EP | 0632427 | A2 | 1/1995 |
| EP | 1710784 | A1 | 11/2006 |
| EP | 1748415 | A2 | 1/2007 |
| EP | 1748418 | A1 | 1/2007 |
| JP | 53-028414 | | 3/1978 |
| JP | 02-074997 | A | 3/1990 |
| JP | 03-182798 | A | 8/1991 |
| JP | 4-285765 | A | 10/1992 |
| JP | 7-325579 | A | 12/1995 |
| JP | 08-006549 | A | 1/1996 |
| JP | 8-110826 | A | 4/1996 |
| JP | 08-221074 | A | 8/1996 |
| JP | 09-068980 | A | 3/1997 |
| JP | 09-212157 | A | 8/1997 |
| JP | 09-319362 | A | 12/1997 |
| JP | 10-097251 | A | 4/1998 |
| JP | 2001-009152 | A | 1/2001 |
| JP | 2002-175080 | A | 6/2002 |
| JP | 2002-229567 | A | 8/2002 |
| JP | 2003-177754 | A | 6/2003 |
| JP | 2004-271783 | A | 9/2004 |
| JP | 2004-274570 | A | 9/2004 |
| JP | 2004274570 | A * | 9/2004 |

OTHER PUBLICATIONS

Keitai News, (on-line), Jan. 16, 2002, available at http://k-tai.ascii24.com/k-tai/news/2002/01/16/632762-000.html, with its English translation, accessed on Feb. 23, 2006.

World of Digista Curator, (on-line), Digital Stadium, Toshio Iwai, with its English translation, accessed on Mar. 29, 2006.

Specification and drawings of unpublished related co-pending U.S. Appl. No. 11/681,899, filed Mar. 5, 2007; Performance Apparatus and Tone Generation Method; Yu Nishibori et al.; pp. 1-60.

Office Action issued on Nov. 17, 2006 in Japanese Patent Application No. 2004-200689, from which the present application No. claims priority.

Office Action issued on Nov. 17, 2006 in Japanese Patent Application No. 2004-200690, from which the present application claims priority.

Hajime Tachibana Design and NTT Learning systems Corporation released i-Appli that changes cellular phone to music sequencer; disclosed in "Keitai News" on Jan. 16, 2002.

"TENORI-ON" disclosed in "The World of Digital Stadium Curator", pp. 1-7, on the internet (www.nhk.or.jp/digista/lab/digista_ten/curator.html.), date: Mar 28, 2005.

Japanese Office Action (Decision of Rejection) issued Jan. 30, 2007 in Japanese Patent Application No. 2004-200690 from which the present application claims priority.

European Search Report for European Patent Application No. EP 06015695 which corresponds to related co-pending U.S. Appl. No. 11/495,467; mailing date of Feb. 6, 2007; pp. 2-12.

Partial European Search Report of European Patent Application No. 06015695 which corresponds to related co-pending U.S. Appl. No. 11/495,467; mailing date of Oct. 26, 2006.

"Yamaha's Tenori-On LED-panel instrument", retrieved from http://www.engadget.com, Weblogs, Inc, 2003-2007.

"Keitai News", retrieved from http://k-tai.ascii24.com/k-tai/new/2002/01/16/632762-000.html, on Jan. 16, 2002, Japan (with English Translation).

Toshio Iwai, "World of Digista Curator", [online], Digital Stadium, Japan (with English Translation), date: Mar. 29, 2006.

"TENORI-ON", retrieved fro http://www.global.yahama.com/design, date: 2007.

Office Action issued in European application No. EP 07103475.5, mailed on Jul. 13, 2007, which corresponds to related co-pending U.S. Appl. No. 11/681,899.

Notice of Grounds for Rejection issued in Japanese Patent Appl. No. 2005-293369 which corresponds to related co-pending U.S. Appl. No. 11/493,739. Mailing date: Jun. 19, 2007.

KORG Kaoss Pad KP2 Owner's Manual. 2002.

KORG Kaoss Pad KP2 Website; Accessed May 23, 2007. <http://www.korg.com/gear/info.asp?a_prod_no=KP2>.

Propellerhead Reason Operation Manual. Ludvig Carlson, Anders Nodrmark and Roger Wiklander. 2000.

Extended European Search Report of European Patent Application No. 06015696.5-2218, dated Nov. 20, 2006 which corresponds to related co-pending U.S. Appl. No. 11/493,739.

Notice of Grounds for Rejection issued in Japanese Patent Application No. 2005-293369, from which related co-pending U.S. Appl. No. 11/493,739 claims priority. Mailing date of Feb. 27, 2007.

Notice of Grounds for Rejection, issued in Japanese Patent Application No. 2005-109598, from which related co-pending U.S. Appl. No. 11/398,979 claims priority. Mailing date of Feb. 27, 2007.

Notice of Preliminary Rejection issued for Korean Patent Application No. 10-2006-0031407 dated Jan. 24, 2007, which corresponds to related co-pending U.S. Appl. No. 11/398,979.

Extended European Search Report issued for corresponding European Patent Application No. 06007180.0-2218, dated Jul. 27, 2006, corresponding to related co-pending U.S. Appl. No. 11/398,979.

Partial European Search Report of corresponding European Patent Application No. 06015695.7, date: Oct. 26, 2006.

Extended European search report issued Nov. 13, 2007 in corresponding European patent application EP07103475.5; pp. 1-14. This European application corresponds to related co-pending application No. 11/681,866.

* cited by examiner

PERFORMANCE APPARATUS AND TONE GENERATION METHOD USING THE PERFORMANCE APPARATUS

BACKGROUND OF THE INVENTION

The present invention relates to performance apparatus which receive user's operation of a plurality of key switches and execute a performance in response to the user's operation of the key switches, as well as tone generation methods using the performance apparatus.

Application program called "TENORI-ON" has been known, for example, from

Non-patent Literature 1: "Keitai News" [online], Jan. 16, 2002, ADSCII, [searched on Apr. 1, 2004], the Internet website http://k-tai.ascii24.com./k-tai/news/2002/01/16/632762-000.html?geta, and Non-patent Literature 2: "World of Digista Curator" [online], Digital Stadium, Toshio Iwai, Exhibit=TENORI-ON, [searched on Apr. 1, 2004], the Internet website http://www.nhk.or.jp/digista/lab/digista_ten/curator.html.

In performance apparatus, such as those for portable phones and game apparatus, point-designating inputs entered by a user are received via 16×16 grids that are arranged in a matrix configuration with the horizontal axis representing the timing and the vertical axis representing the tone pitch. These performance apparatus sequentially generate tone pitches corresponding to user-designated points from a leftmost vertical row (or column) onward. In this way, the users can use the performance apparatus to compose and perform simple music pieces with enhanced elaborateness and originality.

In the aforementioned conventional performance apparatus, tone generating data is preset per designatable point, and a music piece is formed by tones being generated repetitively at the individual designated points on the basis of the presettings. Thus, the same music piece is merely repeated at predetermined intervals, so that, with the conventional performance apparatus, the degree of freedom in composing a music piece would be considerably limited. Further, in the conventional performance apparatus, a same pattern of light-emitting display (i.e., illumination) is also repeated at predetermined intervals; thus, the degree of freedom regarding the light-emitting display (i.e., illumination) pattern would also be considerably limited. The user may easily get bored of such repetition of the same music piece and light-emitting display pattern.

SUMMARY OF THE INVENTION

In view of the foregoing, it is an object of the present invention to provide a performance apparatus and tone generation method using the performance apparatus which can form music pieces and light-emitting display patterns with an enhanced degree of freedom by providing different a tone generating interval etc. and light-emitting display per user-designatable point.

In order to accomplish the above-mentioned object, the present invention provides an improved performance apparatus, which comprises: a plurality of key switches arranged to form a plurality of key switch rows; a plurality of light emitting elements provided in corresponding relation to the key switches; a detection section that detects an operated key switch for each of the key switch rows; a light emission control section that sequentially illuminates the light emitting elements, on the basis of detection by the detection section, in such a manner that an illuminated position reciprocates between the operated key switch and the key switch located at a first predetermined position in the key switch row the operated key switch belongs to; and a tone generation section that, in synchronism with the light emission control section illuminating the key switch located at a second predetermined position in the key switch row, generates at least one of tones allocated to the key switch row.

According to the present invention, illumination control (i.e., light emission control) by the light emission control section and tone generation control by the tone generation section is performed independently for each of the key switch rows. Thus, in a case where key switches have been operated in two or more different key switch rows, the illumination control and tone generation control is performed, for each of the rows these operated key switches belong to, in accordance with a different illumination pattern and tone generation pattern. As a result, the present invention can not only readily achieve a great variety of light movement and tone generation, but also perform illumination control and tone generation control with enhanced degree of freedom based on free operation by a user.

As an example, the key switch located at the first predetermined position is the key switch located at one end of the key switch row, and the key switch located at the second predetermined position is at least one of the key switch located at the one end of the key switch row and the operated key. Further, tones are allocated to the individual key switches, and the tone generation section generates the tone allocated to the operated key switch.

In the performance apparatus of the present invention arranged in the above-described manner, the key switches positioned between coordinates of the operated key switch and coordinates of one end of a two-dimensional key-switch-arranged area are sequentially illuminated and deilluminated so that an illuminated position looks as if it were reciprocating between the operated or selected key switch and the one end of the area. Once the light reaches the one end of the two-dimensional key-switch-arranged area, tone generation control is performed in accordance with tone generating data allocated to the selected key switch. Thus, if key switches of a plurality of key switch rows have been selected, tones are generated and audibly output with time intervals corresponding to coordinate distances between the individual selected keys and the one end of the two-dimensional key-switch-arranged area. Thus, the present invention can achieve a great variety of light movement and tones. X- and Y-coordinates used in connection with the present invention are not necessarily limited to the coordinate system where the horizontal direction is defined as the X-axis direction while the vertical direction is defined as the Y-axis direction and where the X-coordinate increases in a left-to-right direction (as the user faces the front of the apparatus) and the Y-coordinate increases in a bottom-to-top direction. For example, the switch rows may be arranged in an oblique direction.

Further, the performance apparatus of the present invention may be arranged so that, in synchronism with the light emission control section illuminating the operated key switch of a given key switch row, the tone generation section generates a tone with tone quality and pitch allocated to the given key switch row.

As noted above, the tone generation control is performed not only when the light has reached the one end of the two-dimensional key-switch-arranged area, but also when the light has reached the operated key switch. In this way, the present invention can achieve even further diversified movement of light and tone generation.

Further, the performance apparatus of the invention may be arranged in such a manner that, once the key switch located at one end of any one of the key switch rows is depressed, the key switch selection in that key switch row is terminated so that the operation of the light emission control section and tone generation section for that key switch row is stopped.

With such an arrangement, the selection of the key switch being subjected to the light emission control and tone generation can be terminated in response to depression of the key switch located at the one end. Thus, in a case where two or more key switches have been selected in two or more key switch rows, the combination of the selected key switches can be changed as desired with ease, so that the present invention can achieve even further diversified movement of light illumination and diversified tone generation.

According to another aspect of the present invention, there is provided another improved performance apparatus, which comprises: a plurality of key switches provided at a plurality of predetermined positions; a plurality of light emitting elements provided in corresponding relation to the positions where the plurality of key switches are provided; a detection section that detects duration of operation of a key switch having being operated among the plurality of light emitting elements; a light emission control section that, in accordance with the duration of operation detected by the detection section, controls light emission of the light emitting elements located in a predetermined key-switch-arranged range including the operated key switch; and a tone generation section that generates a tone, corresponding to the operated key switch, after imparting the tone with an effect corresponding to the detected duration of operation. With such arrangements, the present invention can perform illumination and tone generation control corresponding to duration of user's operation of the key switch; thus, the present invention can perform illumination control and tone generation control with enhanced degree of freedom based on user's free operation and thereby greatly diversify the illumination control and tone generation control.

For example, when any one of the key switches has been selected, a tone is generated with tone quality, length and pitch allocated to the selected key switch, and simultaneously, the light emitting element corresponding to the key switch is illuminated. Once the time over which the selection of the key switch lasts (i.e., duration of operation of the key switch) has exceeded a predetermined time, the tone is generated with some effect imparted to the allocated tone quality, length and pitch, and simultaneously, an illumination pattern of the light emitting elements in a predetermined key-switch-arranged range, including the light emitting element provided in the selected key switch, is caused to vary. In this way, diversified tones and illumination patterns can be provided in accordance with various duration of operation of the key switches.

In this way, the present invention can provide a different tone generation pattern for each key switch row (or line) which a selected key switch belongs to, and thus, it can achieve tones that do not involve a repetition pattern of a relatively short cyclic period. Also, the present invention can provide a different illumination pattern for each key switch row (or line) which a selected key switch belongs to, and thus, it can achieve illumination patterns that do not involve a repetition pattern of a relatively short cyclic period. In the present invention, the user only has to perform operation for selecting desired key switches, and thus, there can be readily achieved music piece performances and illumination patterns with enhanced elaborateness and originality and enhanced degree of freedom.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE INVENTION

Now, with reference to the drawings, a description will be given about a performance apparatus in accordance with embodiments of the present invention. This performance apparatus includes a plurality of key switches arranged in a matrix on a casing in the form of a substantially-flat rectangular parallelepiped, and it performs a music piece on the basis of selection of a desired number of the key switches. Further, this performance apparatus is constructed to provide tone generating data of different tone generating patterns and light-emitting display (or illumination) patterns in accordance with distances between the selected key switches and a predetermined end of a matrix display section. Thus, the performance apparatus of the present invention can not only readily perform a music piece with higher elaborateness and originality and higher degree of freedom than the conventional performance apparatus, but also achieve complicated illumination patterns.

Figure 1:
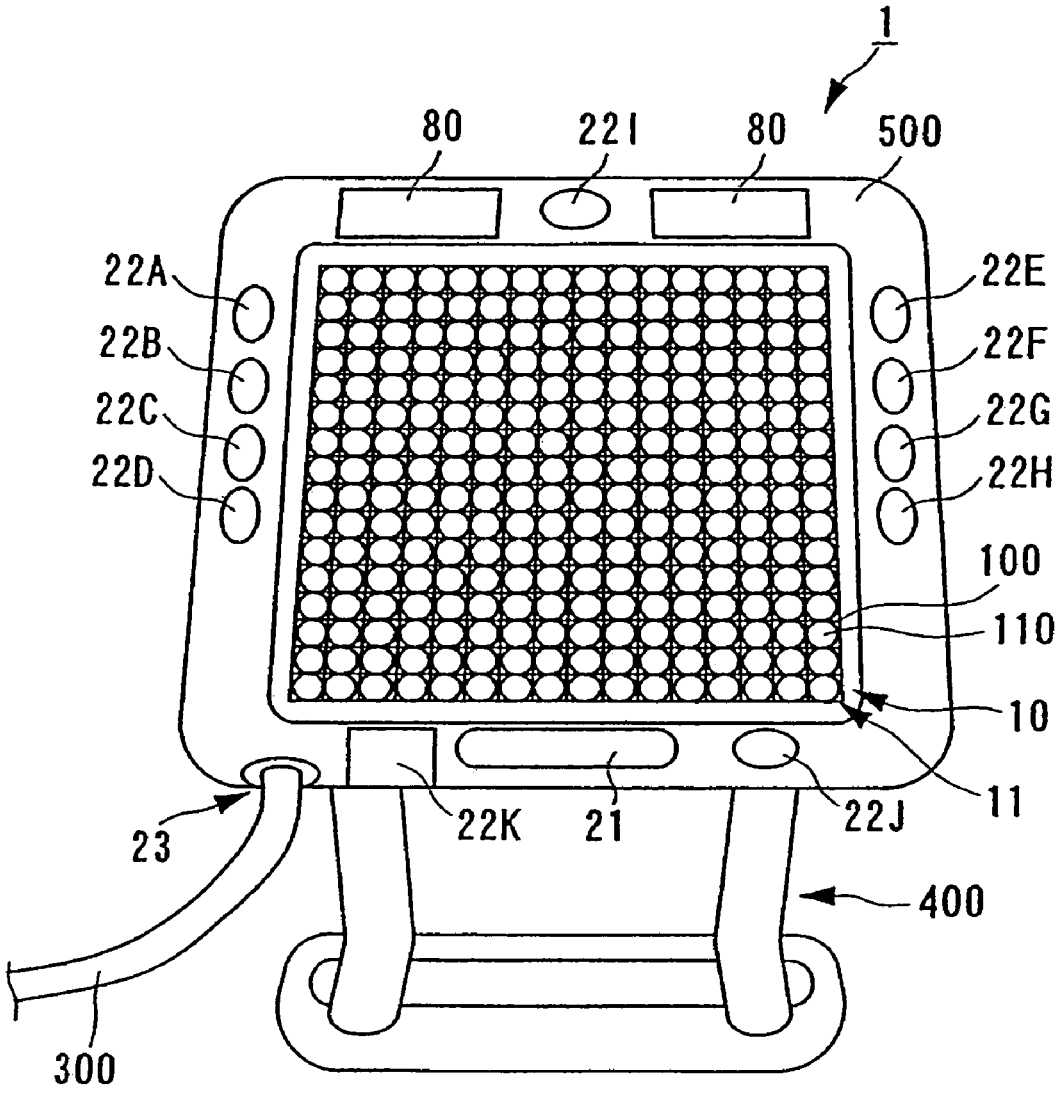
FIG. 1 is a perspective view showing an external appearance of a performance apparatus in accordance with a first embodiment of the present invention.
Figure 2:
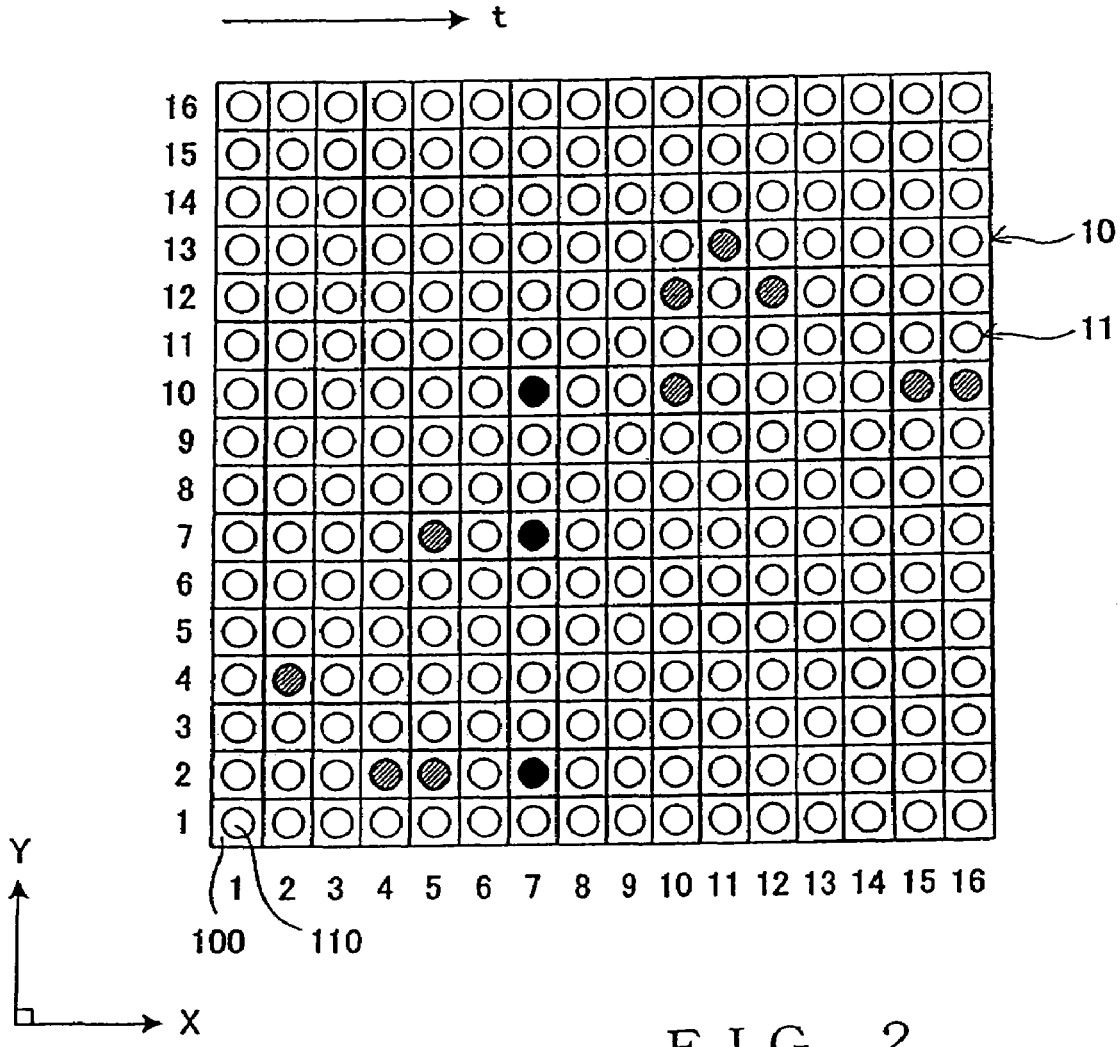
FIG. 2 is a view showing a key switch group and light-emitting display element group as viewed from the front (i.e., user side) of the performance apparatus of FIG. 1.

FIG. 1 is a view of the performance apparatus 1 in accordance with a first embodiment of the present invention. FIG. 2 is a view showing a key switch group 10 and light-emitting display elements 110 as viewed from the front (i.e., user side) of the performance apparatus 1 of FIG. 1.

The performance apparatus 1 includes the casing 500 in the form of a substantially-flat rectangular parallelepiped and is supported on a stand 400. On the upper surface of the casing 500, there are arranged key switches 100 of the key switch group 10 in a two-dimensional matrix. More specifically, the key switch group 10 comprises a total of 256 key switches 100 arranged in two dimensions, with 16 key switches in each of two orthogonal (i.e., vertical and horizontal) directions of the upper surface of the casing 500.

Each of the key switches 100 is a push-type switch with the light-emitting display element 110, including an LED etc., built therein. All of the light-emitting display elements 110 together constitute a light-emitting display element group 11. Each of the light-emitting display elements 110 emits light in response to the user depressing a corresponding one of the key switches 100. Thus, the light-emitting display element group 11 can emit light in a predetermined pattern in accordance with a combination of a selected one of the control switches 22 (to be described later) and a selected one or ones of the key switches 100.

Position of each of the key switches 100 of the key switch group 10 and each of the light-emitting display elements 110 of the light-emitting display element group 11 is indicated by two-dimensional coordinates with its position in the vertical direction as a Y-coordinate and its position in the horizontal direction as an X-coordinate. Let it be assumed here that the coordinates of the key switch 100 located at the left lower end (as the user faces) of FIG. 2 are "mtSW (1, 1)" and the coordinates of the key switch 100 located at the right upper end (as the user faces) of FIG. 2 are "mtSW (16, 16)". Let it also be assumed here that the coordinates of the light-emitting display element 110 located at the left lower end (as the user faces) of FIG. 2, corresponding to the left-lower-end key switch 100, are "mtLED (1, 1)" and the coordinates of the light-emitting display element 110 located at the right upper end (as the user faces) of FIG. 2, corresponding to the right-upper-end key switch 100, are "mtLED (16, 16)".

Control buttons 22A-22D are disposed on a left edge portion of the casing 500 located to the left (as the user faces) of the key switch group 10 and light-emitting display element group 11, while control buttons 22E-22H are disposed on a right edge portion of the casing 500 located to the right (as the user faces) of the key switch group 10 and light-emitting display element group 11. Further, a control button 22I and stereo speakers 80 are disposed on an upper edge portion of the casing 500, while control buttons 22J and 22K and a liquid crystal display section 21 are disposed on a lower edge portion of the casing 500. Further, an input terminal 23, to which is connected one end of a connecting cable 300, is provided on a lower end surface of the casing 500 adjacent to the lower edge portion. The connecting cable 300 is connected at the other hand to another performance apparatus which is a communicating party of the performance apparatus 1. Namely, the performance apparatus 1 communicates with the other performance apparatus via the connecting cable 300.

Figure 3:
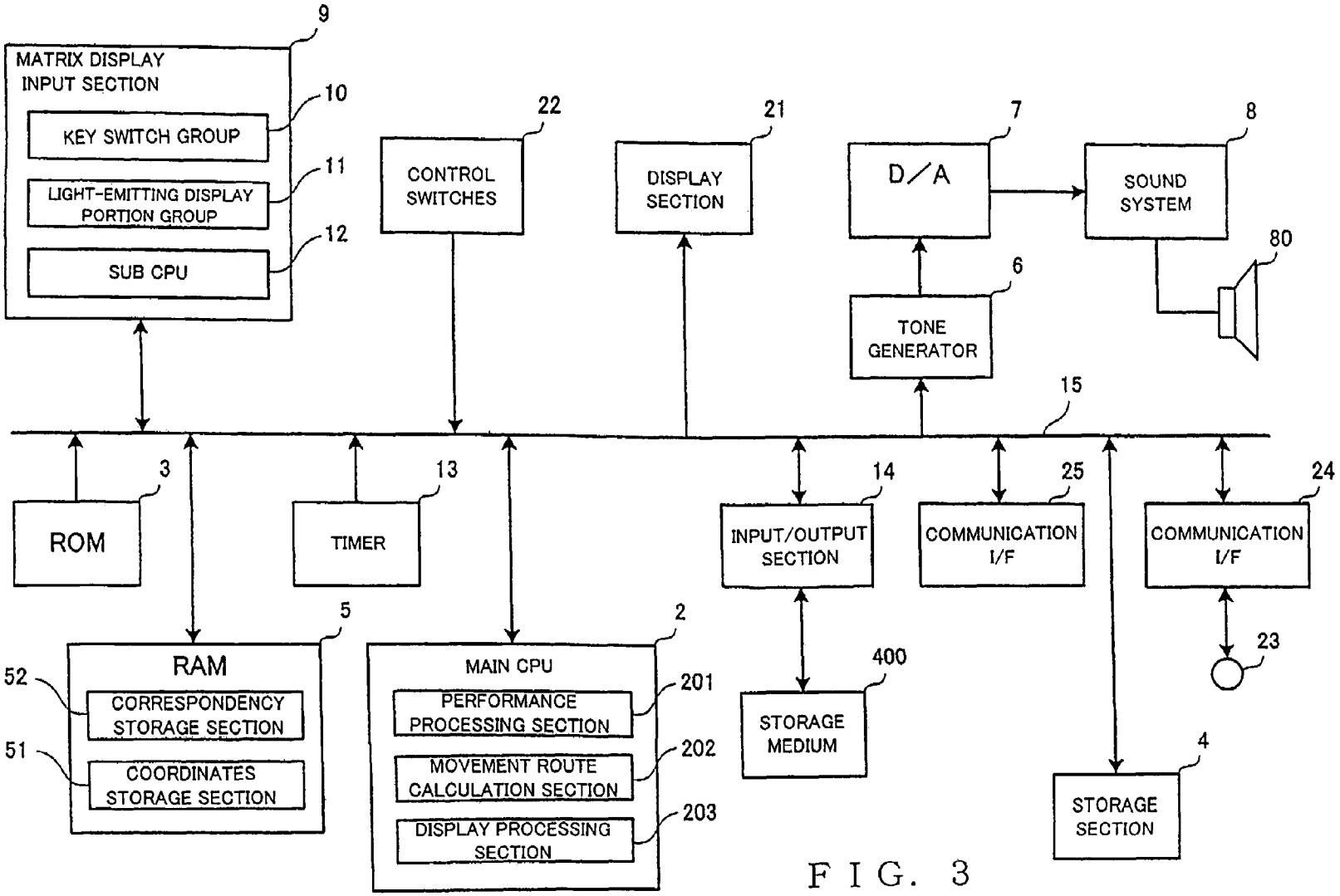
FIG. 3 is a block diagram showing an example electrical setup of the performance apparatus shown in FIG. 1.

FIG. 3 is a block diagram showing an example electrical setup of the performance apparatus 1 shown in FIG. 1.

The performance apparatus 1 includes a main CPU 2, ROM 3, storage section 4, RAM 5, tone generator 6, matrix display input section 9, display section 21, control switches 22, timer 13, input/output section 14, communication interface (I/F) 24 for communication with other equipment and communication interface (I/F) 25, which are connected with one another via a bus line 15.

The ROM 3 has prestored therein a startup program for starting up the performance apparatus 1. The storage section 4 is a rewritable data storage means, such as a flash memory or hard disk. In the storage section 4, there are prestored predetermined programs, including a performance processing program for causing the performance apparatus 1 to execute a performance, as well as predetermined data necessary for execution of the programs. The predetermined data include, for example, tone generation setting data that include data indicative of correspondency between the individual key switches 100 and tone pitches allocated to the key switches 100, and data indicative of a reference tone color to be set by default in the tone generator 6. The tone generation setting data are preset, for example, on the basis of the MIDI standard.

The RAM 5 functions as a working area for the main CPU 2, which temporarily stores a program and data read out from the storage section 4. Further, the RAM 5 includes a coordinates storage section 51 storing data indicative of the coordinates of the key switch group 10 shown in FIG. 1, and a correspondency storage section 52.

The coordinates storage section 51 stores ON/OFF states of the individual key switches 100. The coordinates storage section 51 comprises a 16×16 table of the same arrangement and shape as the key switch group 10 shown in FIG. 2. In the coordinates storage section 51, each of the 16×16 locations corresponding to the key switches 100 is in the form of a one-bit flag. If any one of the key switches 100 has been depressed (or operated) for a predetermined time length, one of the locations which corresponds to the depressed key switch 100 is set at a value "1" indicating an ON state of the key switch 100; when the location corresponding to the key switch 100 is set at a value "0", the location indicates an OFF state of the key switch 100.

The correspondency storage section 52 comprises a note number table T storing a list of note numbers to be allocated to the individual key switches 100. In the note number table T employed in the instant embodiment, 16 note numbers are allocated, through initial setting, to the Y-coordinates (=1-16); the same 16 note numbers are allocated to each of 16 Y-coordinate groups (or columns) corresponding to the X-coordinates (=1-16) so that the same tone pitches are selectable for each of the 16 X-coordinates. Here, the "note number" is a numerical value indicative of a tone pitch or the like, which is given from a later-described performance processing section 201 to the tone generator 6; note number "60" is indicative of a center scale note "C4". In the instant embodiment, note numbers "60" to "75" are allocated to the Y-coordinates; according to the default settings on start-up of the performance apparatus, note number "60" is allocated to Y-coordinate "1", note number "61" to Y-coordinate "2", and so on, until note number "75" is allocated to Y-coordinate "16". Alternatively, a different note number may be allocated to each of the 16×16 (=256) switches 100. Further, the note numbers to be allocated to the key switches 100 are not limited to "60"-"75".

The tone generator 6 is, for example, a MIDI tone generator (i.e., tone generator capable of generating a tone or audio waveform signal in accordance with MIDI information), which generates a digital audio (tone) signal with a predetermined tone color and passes the generated digital audio signal to the D/A converter 7. In the instant embodiment, the tone generator 6 can generate, on the basis of tone data (waveform data) stored in memory, digital audio (tone) signals of any of not only a plurality of kinds of internally-stored tone colors or internal tone colors (e.g., piano tone color, guitar tone color, etc.) but also externally-acquired desired tone colors (external tone colors). In the tone generator 6, a plurality of kinds of tone data are set, as the tone waveform data of the external tone colors, with respective note numbers assigned thereto. For example, the tone generator 6 includes a readable/writable non-volatile memory for storing external tone color data, and a plurality of kinds of tone data (waveform data) of the above-mentioned external tone colors are stored in the memory with respective predetermined note numbers assigned thereto in accordance with their tone pitch frequencies. The note numbers are associated with the key switches 100 through the above-mentioned note number table T; namely, the plurality of kinds of tone data are assigned respective note numbers in accordance with their respective pitches, so that they are associated with the key switches 100. The tone generator 6 receives, from the main CPU 2, not only tone color designation but also note number designation of a tone to be generated, to thereby read out, from the above-mentioned memory, tone data (waveform data) based on the designated tone color and tone number. Thus, the tone generator 6 generates a digital audio (tone) signal on the basis of the read-out tone data (waveform data) so that the digital audio signal is audibly reproduced or sounded for a predetermined time length (e.g., 200 msec). Note that the note number of the tone to be generated can be designated either by the user turning on a desired one of the switches 100 or on the basis of separately-stored automatic performance information. Note that the tone data (waveform data) to be stored in the memory may be in any desired compressed format other than the PCM format, such as DPCM or ADPCM format.

The D/A converter 7 converts the digital audio signal, received from the tone generator 6, into an analog audio signal and supplies the analog audio signal to the sound system 8. The sound system 8 audibly reproduces or sounds the supplied analog audio signal through the speakers 80.

The matrix display input section 9 comprises the key switch group 10 and light-emitting display element group 11 described above in relation to FIG. 1, and a sub CPU 12.

The sub CPU 12 detects the coordinates of each depressed key switch 100 (FIG. 2) and supplies the detected coordinates to the main CPU 2 as depressed key switch position information.

The timer 13 counts time to inform the main CPU 2 of the counted time. The input/output section 14 is an interface circuit for inputting/outputting data from/to a storage medium 400. The control switches 22 are operable by the user to give various control instructions.

The main CPU 2, which controls operation of each component connected thereto, executes a performance program so as to function as a performance processing section 201, movement route calculation section 202 and display processing section 203.

The performance processing section 201 uses the tone generation setting data, stored in the storage section 4, to control the audio signal generation by the tone generator 6 so that a tone, corresponding to each key switch 100 operated by the user, is generated. More specifically, as an initialization process, the performance processing section 201 designates a predetermined initial tone color to the tone generator 6 and registers, by the above-mentioned initial setting, the note numbers, corresponding to the Y-coordinates of the individual key switches 100, into the note number table T.

The performance processing section 201 receives depressed key switch position information from the sub CPU 12 to detect the coordinates of a user-depressed key switch 100.

The performance processing section 201 refers to the note number table T to identify the note number corresponding to the detected coordinates and inform the tone generator 6 of the identified note number. Thus, the tone generator 6 generates an audio signal, corresponding to the key switch 100 depressed by the user, with the currently-set tone color.

The movement route calculation section 202 calculates a coordinates movement route mt extending from the acquired coordinates of the key switch 100 vertically toward a predetermined one side (or one end) of the matrix display input section 9.

Figure 4:
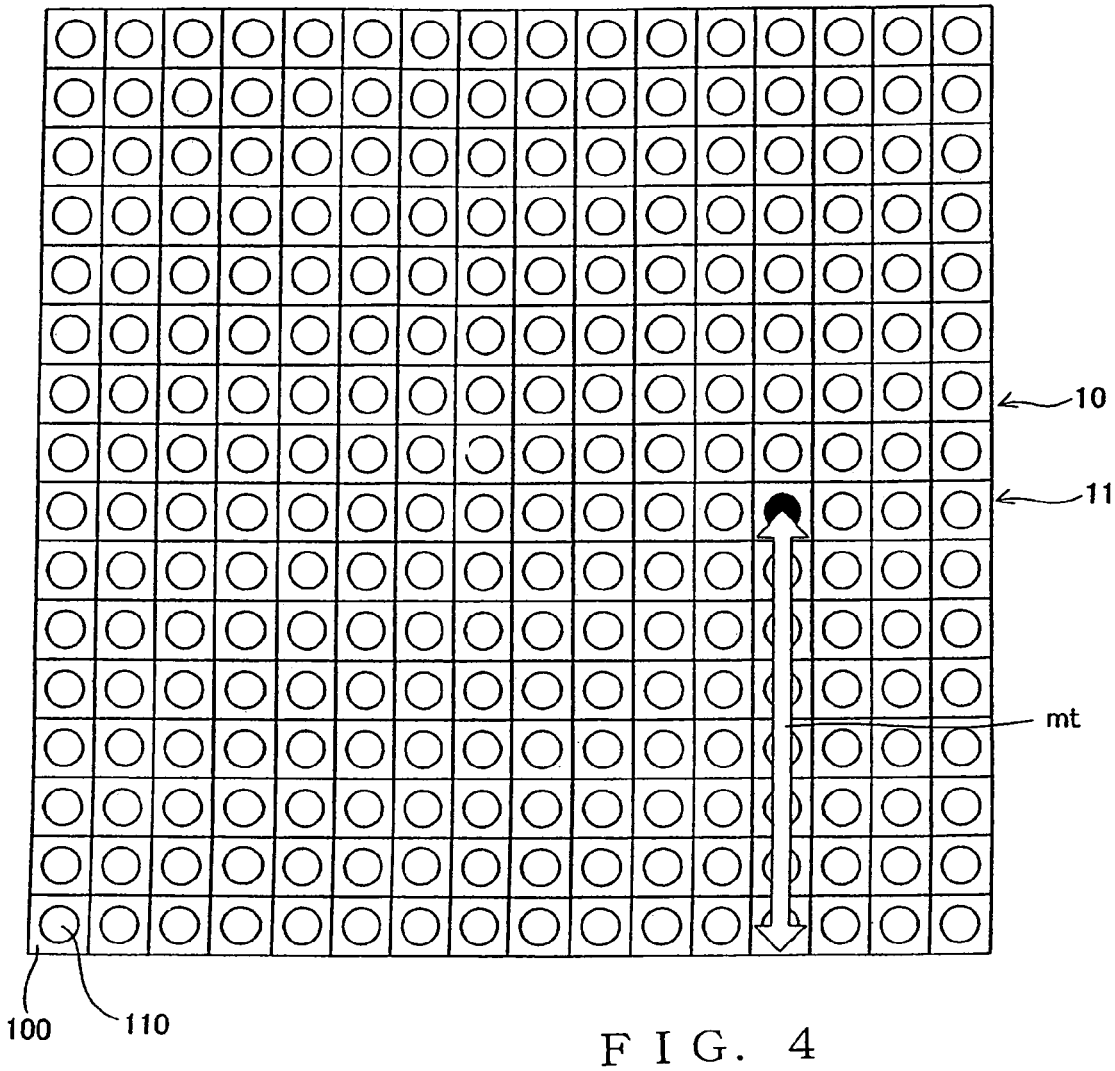
FIG. 4 is a diagram showing relationship between acquired coordinates of key switches and a movement route in a bouncing mode.

FIG. 4 is a diagram showing relationship between the acquired coordinates of the key switches 100 and the movement route in a so-called "bouncing mode".

As illustrated in FIG. 4, the movement route mt is a route along which coordinates moves, step by step at predetermined time intervals, from the coordinates selected by the user depressing a desired one of the key switches 100 (hereinafter "selected coordinates") vertically downward or upward (in the Y-axis direction) toward a first predetermined position (e.g., the lower end) of the matrix display input section 9 and, upon arrival at the first predetermined position (e.g., lower-end) coordinates, the coordinates "bounce back" vertically upward or downward (in the Y-axis direction) to the selected coordinates. Further, according to the movement route mt, the coordinates again bounce back at the selected coordinates and move vertically downward. Namely, the movement route mt is a coordinates movement trajectory along which the coordinates reciprocate between the selected coordinates of the user-depressed key switch 100 as a starting point of the route and the lower-end coordinates of the matrix display input section 9 having the same X-coordinate as the selected coordinates.

On the basis of the calculated movement route mt and preset coordinates moving velocity and in response to the user's selection of the key switches 100, the movement route calculation section 202 sequentially supplies the display processing section 203 with the coordinates of the individual key switches 100 between the depressed or selected key switch 100 and the lower end of the matrix display input section 9. Also, the movement route calculation section 202 supplies the performance processing section 201 with information indicative of a time at which the illuminated coordinates (position) on the calculated movement route mt reach the lower end of the matrix display input section 9 and a time at which the illuminated coordinates reach the coordinates of the selected switch 100.

Then, the performance processing section 201 performs tone generation processing in response to the informed times, in which it refers to the note number table T to identify the note number corresponding to the detected coordinates and inform the tone generator 6 of the identified note number. Thus, the tone generator 6 generates an audio signal, corresponding to the user-depressed key switch 100, with the currently-set tone color. Namely, in the "bouncing mode", the tone generator 6 performs tone generation processing corresponding to the selected key switch 100 at a time point when the coordinates on the movement route mt have coincided with the lower-end coordinates of the matrix input section 9.

Such calculation of the movement route mt and the tone generation processing are carried out in parallel for individual selected key switches 100. Namely, for each selected key switch 100, the calculation of the movement route mt and the tone generation processing at predetermined timing are carried out. In this case, either a same coordinates moving velocity or different coordinates moving velocity may be set for individual movement routes calculated.

Thus, tones output from the tone generator 6 are a combination of tones which are allocated in advance to individual selected key switches 100 and are generated in tone-generating cycles corresponding to distances between the respective selected keys 100 and the lower end of the input section 9, and these tones output in such a combination are extremely random and have low correlativity with respect to each other. As a result, the tones output from the tone generator 6 can have extremely high elaborateness, originality and degree of freedom.

The display processing section 203 performs display processing to control the light-emitting display or illumination of the light-emitting display element group 11.

Figure 5:
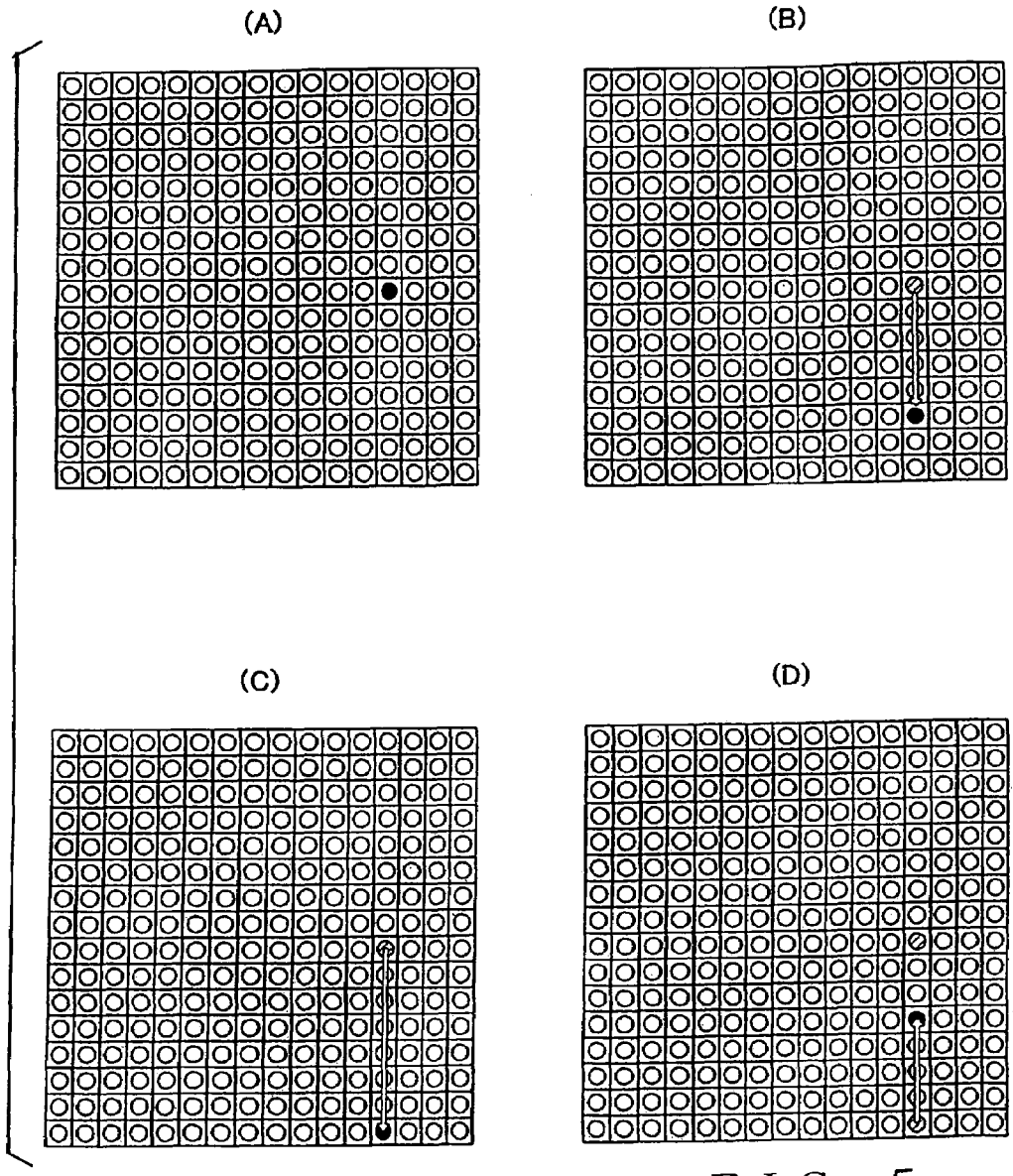
FIG. 5 is a conceptual diagram showing illuminating operation of a matrix display input section in the bouncing mode.
Figure 6:
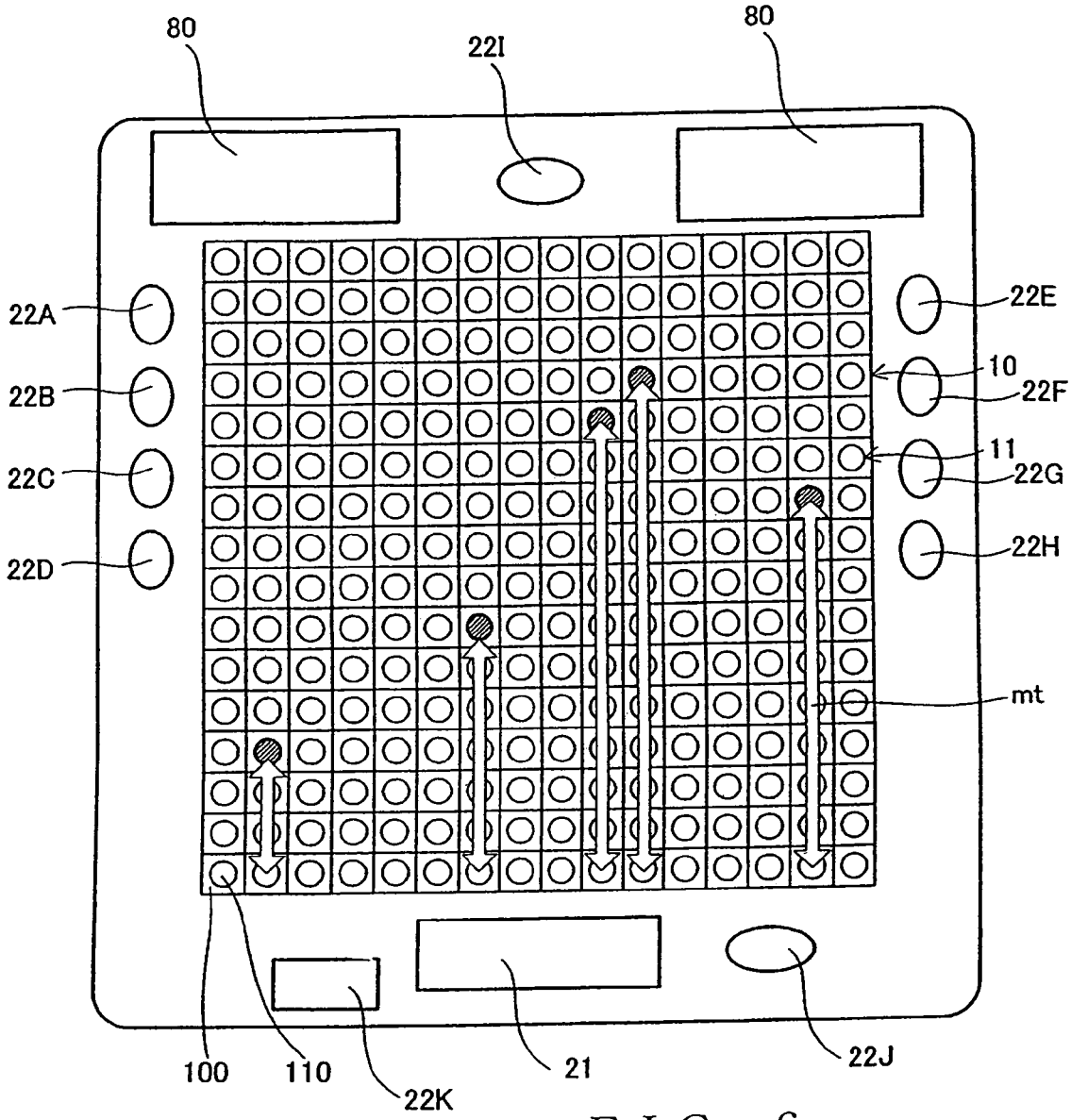
FIG. 6 is a view of the matrix display input section with a plurality of key switches selected in the bouncing mode.

FIG. 5 is a conceptual diagram showing light-emitting or illuminating states of the matrix display input section 9 at a time point when any one of the key switches 100 has been selected ((A) of FIG. 5), at a time point when the moving coordinates move along the movement route mt from the selected key switch 100 toward the lower end of the matrix display input section 9 (B), at a time point when the moving coordinates reach the lower end of the matrix display input section 9 (C), and at a time point when the moving coordinates move along the movement route mt from the lower end of the matrix display input section 9 toward the selected key switch 100.

In the display processing, the display processing section 203 sequentially illuminates, with a high light intensity, the light-emitting display elements, corresponding to the key switches 100 located on the movement route mt on the basis of timing and coordinates given from the movement route calculation section 202. Once the user selects the key switch 100 of mtSW(13, 8) as illustrated in (A) of FIG. 5, the corresponding light-emitting display element of mtLED(13, 8) is illuminated with the high light intensity. Then, the moving coordinates are sequentially moved downward in accordance with the given timing, so that the light-emitting display element of mtLED(13, Y1) is illuminated with the high light intensity as illustrated in (B) of FIG. 5. Once the moving coordinates reach the lower end of the matrix display input section 9, the light-emitting display element of mtLED(13, 1) corresponding to the lower-end key switch 100 is illuminated with the high light intensity as illustrated in (C) of FIG. 5. Then, the moving coordinates are sequentially moved upward in accordance with the given timing, so that the light-emitting display element of mtLED(13, Y2) is illuminated with the high light intensity as illustrated in (D) of FIG. 5. In this manner, the display processing section 203 sequentially illuminating the light-emitting display elements 110 located on the movement route mt while causing the moving coordinates to reciprocate along the movement route mt. Thus, it looks to the user as though light were constantly moving while bouncing between the selected key switch 100 and the lower end of the input section 9.

The following paragraphs describe processing performed in the instant embodiment of the performance apparatus.

Figure 7:
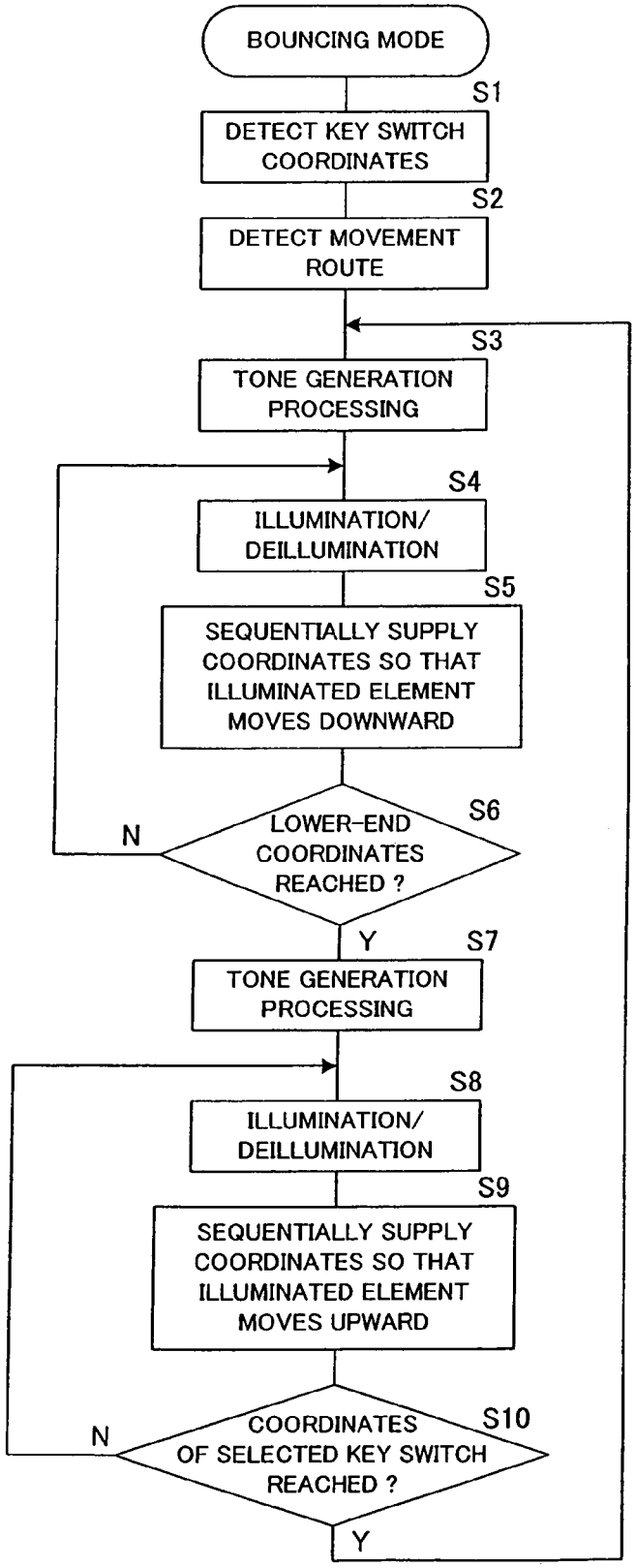
FIG. 7 is a flow chart of bouncing mode processing performed in the first embodiment of the performance apparatus.

FIG. 7 is a flow chart of bouncing mode processing performed in the instant embodiment of the performance apparatus.

If the user keeps depressing any desired one of the key switches 100, the sub CPU 12 of the matrix display input section 9 sets the depressed key switch 100 to a selected state and supplies the main CPU 2 with coordinates information corresponding to the depressed or selected key switch 100 (step S1).

On the basis of the supplied coordinates, the movement route calculation section 202 of the main CPU 2 calculates coordinates of the lower end of the matrix display input section 9 which has the same X-coordinate as the selected key switch 100 and thereby calculates a movement route mt (S2). Further, the performance processing section 201 of the main CPU 2 supplies the tone generator 6 with the tone generating data corresponding to the selected key switch 100 to generate a predetermined tone (step S3). Also, the display processing section 203 performs illumination/deillumination processing on the light-emitting display element 110 corresponding to the selected key switch 100 (step S4).

The movement route calculation section 202 of the main CPU 2 sequentially supplies coordinates so that the illuminated position moves along the calculated movement route mt toward the lower end of the matrix display input section 9 (step S5), and the display processing section 203 performs the illumination/deillumination processing per supplied coordinates until the coordinates of the lower end of the matrix display input section 9, i.e. coordinates of the lower end of the movement route, are supplied (step S6→step S4).

Once the coordinates of a second predetermined position (e.g., the lower end) of the movement route mt are supplied as determined at step S6, the performance processing section 201 of the main CPU 2 supplies the tone generator 6 with the tone generating data corresponding to the selected key switch 100 to generate a predetermined tone (step S7), and the display processing section 203 performs the illumination/deillumination processing on the light-emitting display element 110 of the lower-end coordinates (step S8).

Once the illuminated position reaches the lower end of the matrix display input section 9, the movement route calculation section 202 of the main CPU 2 sequentially supplies coordinates so that the illuminated position moves upward on the matrix display input section 9 along the calculated movement route mt (step S9), and the display processing section 203 performs the illumination/deillumination processing per supplied coordinates until the coordinates of the selected key switch 100 are supplied (step S10→step S8).

The loop process (step S10→step S8) continues to be carried out until a stopping instruction is given by the user, e.g. by the user depressing the key switch 100 corresponding to a third predetermined position (e.g., the above-mentioned lower-end) coordinates. Such a stopping operation can be set for each selected key switch, and the user can readily change a combination of the selected key switches 100; thus, desired changes can be easily made to the music piece in question.

The embodiment has been described above in relation to the case where the horizontal direction is defined as the X-axis direction while the vertical direction is defined as the Y-axis direction, and where the coordinate system is set such that the X-coordinate increases in the left-to-right direction (as the user faces the matrix display input section 9 (and the Y-coordinate increases in the bottom-to-top direction. However, the definitions of these directions etc. are just illustrative, and the directions etc. may be set in any other desired manners. For example, the right end, left end or upper end, rather than the lower end, of the matrix display input section 9 may be set as the "bouncing-back end", as long as the bouncing-back end is a predetermined position.

Next, a description will be given about a performance apparatus in accordance with a second embodiment of the present invention.

The second embodiment is identical to the above-described first embodiment in terms of the mechanical and electrical constructions, but different from the latter in terms of the tone generation processing and illumination/deillumination processing. The following paragraphs describe in detail differences of the second embodiment from the first embodiment.

In the second embodiment, the storage section 4 has prestored therein, in addition the tone setting data for the individual key switches 100, effect information to be used when any of the corresponding key switch 100 has been kept depressed for more than a predetermined time in a "push mode" that will be later described in detail. The storage section 4 has also prestored therein illumination patterns of the light-emitting display elements 110; each of the illumination patterns is used when the corresponding key switch 100 has been kept depressed for more than a predetermined time in the "push mode".

Using the tone setting data stored in the storage section 4, the performance processing section 201 controls the audio signal generating operation of the tone generator 6 to generate a tone corresponding to the key switch 100 operated by the user for a performance. More specifically, as the initialization process, the performance processing section 201 designates a predetermined initial tone color to the tone generator 6 and registers, by the above-mentioned initial setting, the note numbers, corresponding to the Y-coordinates of the individual key switches 100, into the note number table T.

The performance processing section 201 receives depressed key switch position information from the sub CPU 12 to detect the coordinates of a user-depressed key switch 100.

The performance processing section 201 performs the tone generation processing, in which it refers to the note number table T to identify the note number corresponding to the detected coordinates and inform the tone generator 6 of the identified note number. In this way, the tone generator 6 generates an audio signal, corresponding to the key switch 100 depressed by the user, with the currently-set tone color.

On the basis of the coordinates of the selected key switch 100 obtained via the performance processing section 201, the display processing section 203 performs display processing to control the light-emitting display or illumination of the corresponding light-emitting display element 110.

Here, the main CPU 2 measures a continuous depression time (i.e., duration of depression) of each user-depressed key switch 100 on the basis of the depression information given from the sub CPU 12. When the continuous depression time (i.e., duration of depression) of the key switch 100 kept depressed by the user has exceeded a predetermined threshold time value, the main CPU 2 performs "push mode" shifting control on the performance processing section 201 and display processing section 203.

Upon detection of the shift to the "push mode", the performance processing section 201 reads out the effect information from the storage section 4 and time-serially perform an effect process on the tone generating data. The effect process is intended to gradually vary the tone pitch, tone length and tone volume, i.e. execute frequency modulation, cyclic period variation and amplitude variation.

With such processing, there can be provided a great variety of successive tone generating data in accordance with various time lengths or duration of key switch depression by the user. Further, by the user keeping depressing two or more of the key switches, it is possible to readily provide even further diversified tone data with enhanced elaborateness, originality and degree of freedom. In this case, depression of the two or more key switches need not necessarily be started at the same time; if the depression of these key switches is started at different times, there can be provided even further diversified tone data. Further, although the same effect information may be used for all of the key switches, different effect information may be used for the individual key switches so that the degree of freedom of the tone data can be significantly enhanced.

Further, upon detection of the shift to the "push mode", the display processing section 203 reads out a illumination pattern from the storage section 4 and controls the light emission or illumination of the corresponding light-emitting display elements 110 in accordance with the read-out illumination pattern.

Figure 8A:
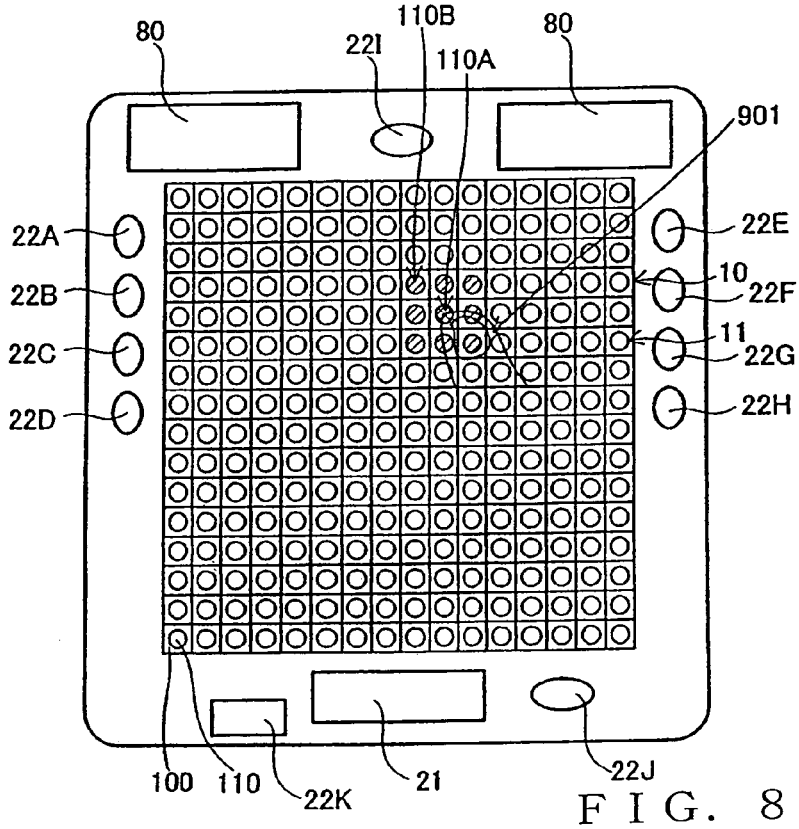
FIGS. 8A and 8B are diagrams showing illumination patterns of the matrix display input section in the bouncing mode.
Figure 8B:
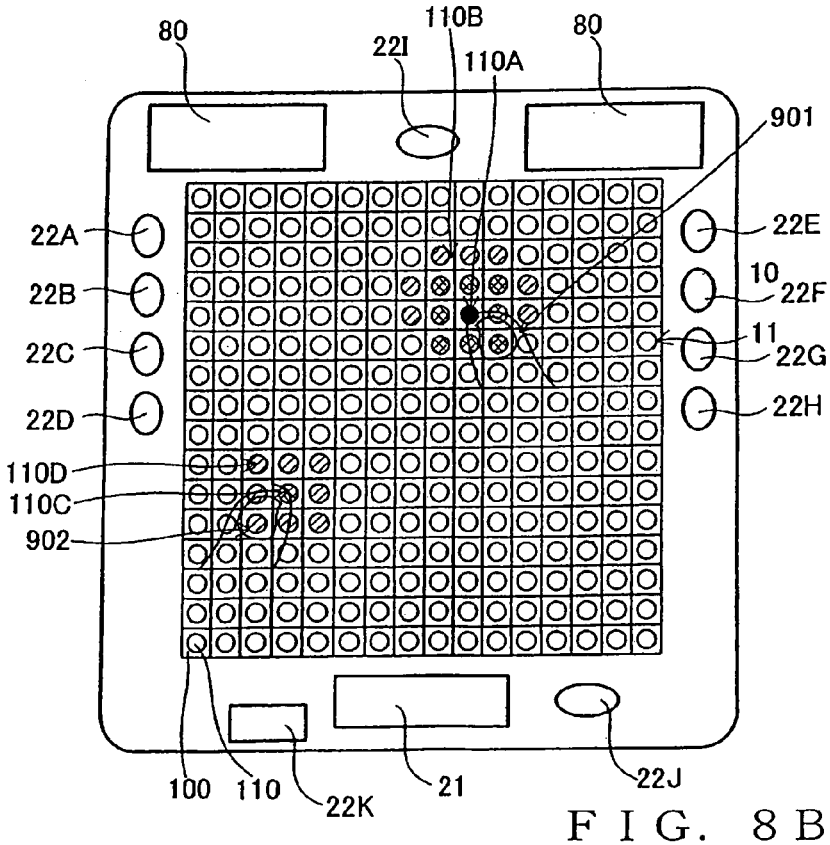

FIG. 8A is a diagram showing an illumination pattern of the matrix display input section 9 at the beginning of the push mode when only one key switch has been depressed by the user (one point depression), and FIG. 8B is a diagram showing an illumination pattern of the matrix display input section 9 when a predetermined time has passed with two key switches depressed by the user.

Upon detection of the shift to the "push mode" at a given key switch 100A, the display processing section 203 starts performing, in a state where the light-emitting display element 110A corresponding to the given key switch 100A currently being depressed by the user with a finger 901 has been illuminated as illustrated in FIG. 8A, illumination control on a predetermined range that includes the light-emitting display elements 110B surrounding the light-emitting display element 110A corresponding to the given key switch 100A. During that time, the display processing section 203 increases the light-emitting intensity of the already-illuminated light-emitting display element 110A in accordance with the passage of time.

Further, upon detection of the shift to the "push mode" at another given key switch 100C, the display processing section 203 starts performing, in a state the light-emitting display element 110C corresponding to the other key switch 100C currently being depressed by the user with a finger 902 has been illuminated as illustrated in FIG. 8B, illumination control on a predetermined range that includes the light-emitting display elements 110D surrounding the light-emitting display element 110C corresponding to the key switch 100C. During that time, the range of the light-emitting display elements 110B surrounding the light-emitting display element 110A is gradually expanded.

The illumination pattern is not limited to the one gradually expanded in the manner as noted above, and it may be gradually reduced in light-emitting intensity or increased and reduced in light-emitting intensity in predetermined cycles, and/or increased and reduced in illumination range at predetermined time intervals.

With such processing, there can be provided a great variety of illumination patterns in accordance with various time lengths or duration of key switch depression by the user. Further, by the user keeping depressing two or more of the key switches, it is possible to readily provide even further diversified illustration patterns with enhanced elaborateness, originality and degree of freedom.

As a result, the instant embodiment allows the user to execute a performance very enjoyable not only auditorily but also visually.

Figure 9:
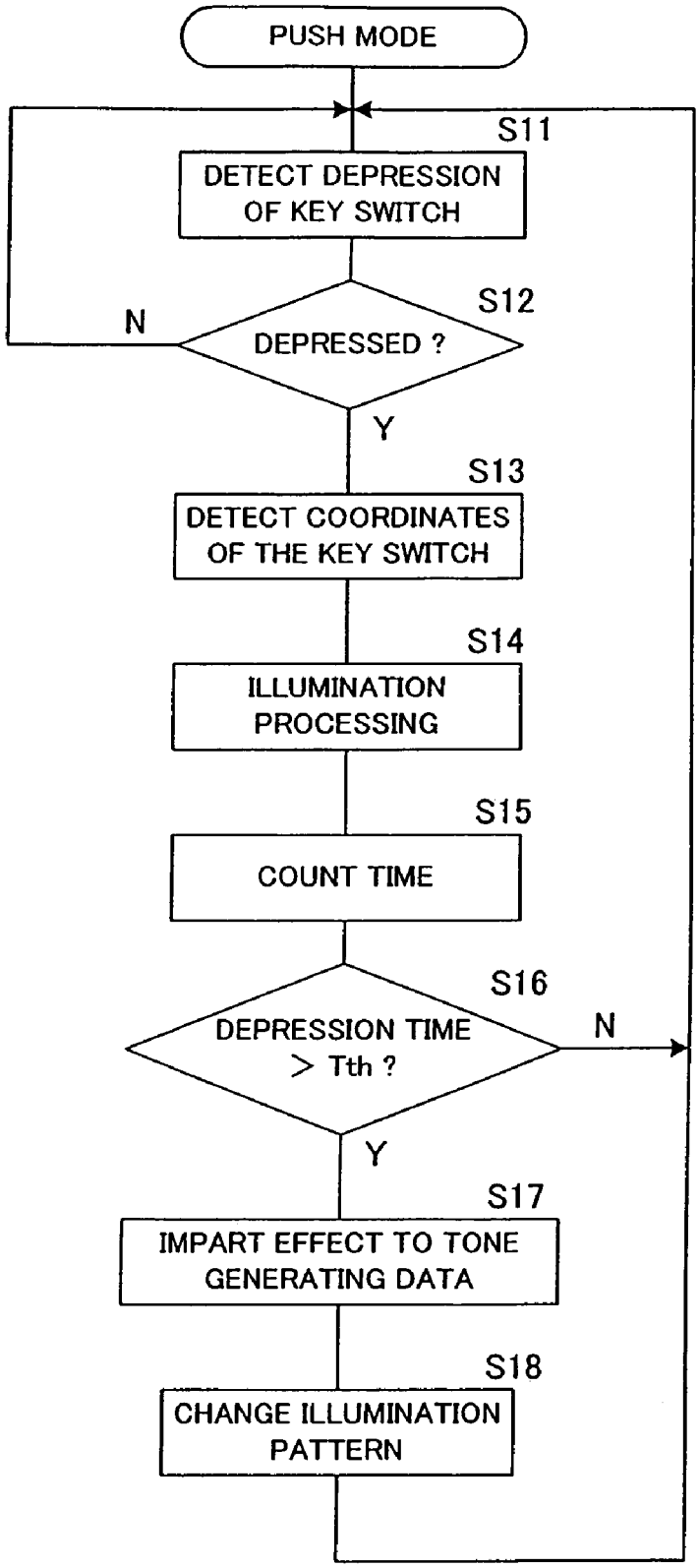
FIG. 9 is a flow chart of push mode processing performed in the second embodiment of the performance apparatus.

FIG. 9 is a flow chart of push mode processing performed in the second embodiment of the performance apparatus.

If the user has kept depressing any desired one of the key switches 100, the sub CPU 12 of the matrix display input section 9 sets the depressed key switch 100 to a selected state and supplies the main CPU 2 with coordinates information corresponding to the depressed or selected key switch 100 (steps S11, S12 and S13).

The performance processing section 201 acquires and sounds tone generating data corresponding to the selected key switch 100, and the display processing section 203 performs normal high-intensity illumination processing on the light-emitting display element 110 corresponding to the selected key switch 100 (step S14).

During that time, the main CPU 2 counts a depression time (i.e., duration of depression) of the selected key switch 100 using the timer 13 (step S15).

Once the counted depression time exceeds a predetermined threshold value Tth (step S16), the main CPU 2 shifts the apparatus to the "push mode", and the performance processing section 201 imparts an effect to the tone generating data (step S17) while the display processing section 203 performs illumination control in accordance with a predetermined illumination pattern (step S18).

Such processing is continued until the depression of the selected key switch 100 is released (steps S18→S11→S12).

With the above-described arrangements, the second embodiment allows the user not only to readily compose music pieces with enhanced elaborateness and originality and degree of freedom, but also to readily obtain display patterns with enhanced visual elaborateness and originality as well as enhanced degree of freedom.

Whereas the embodiment has been described above in relation to the case where, in the bouncing mode, the illuminated position is caused to bounce (i.e., sequential illumination is controlled to occur) in the Y-axis (or vertical) direction in correspondence with X-coordinate positions of depressed keys, the present invention is not so limited. For example, the illuminated position may be caused to bounce or sway (i.e., sequential illumination is controlled to occur) in the X-axis (or horizontal) direction in correspondence with Y-coordinate positions of depressed keys.

Further, the apparatus of the present invention need not necessarily have a tone generator device provided therein; in this case, tone generation instructing information (e.g., MIDI command) may be output from the apparatus of the present invention and supplied to an external tone generator device.

What is claimed is:

1. A performance apparatus comprising:

a plurality of key switches arranged in a plurality of key switch rows;

a plurality of light emitting elements provided in corresponding relation to the key switches;

a detection section that detects an operated key switch for each of the key switch rows;

a light emission control section that sequentially illuminates the light emitting elements, on the basis of detection by said detection section, in such a manner that an illuminated position reciprocates between the operated key switch and the key switch located at a first predetermined position in the same key switch row of the operated key switch; and a tone generation section that generates at least one of tones allocated to the key switch row when the key switch located at a second predetermined position in the same key switch row of the operated key switch is illuminated.

2. The performance apparatus as claimed in claim 1, wherein the key switch located at the first predetermined position is the key switch located at one end of the same key switch row of the operated key switch, and the key switch located at the second predetermined position is at least one of the key switch located at the one end of the same key switch row of the operated key switch or the operated key switch.

3. The performance apparatus as claimed in claim 1, wherein tones are allocated to individual ones of the key switches, and said tone generation section generates the tone allocated to the operated key switch.

4. The performance apparatus as claimed in claim 1, further comprising a stoppage control section that, in response to operation of the key switch located at a third predetermined position in the same key switch row of the operated key switch, stops sequential illumination, by said light emission control section, of the same key switch row of the operated key switch and also stops tone generation, by said tone generation section, associated with the same key switch row of the operated key switch.

5. The performance apparatus as claimed in claim 4, wherein the key switch located at the third predetermined position is the key switch at one end of the same key switch row of the operated key switch.

6. The performance apparatus as claimed in claim 1, wherein said light emission control section sequentially switches the light emitting element to be illuminated from one light emitting element to another so that an illuminated position reciprocates between the operated key switch and the key switch located at one end of the same key switch row of the operated key switch.

7. The performance apparatus as claimed in claim 1, wherein a moving velocity at which said light emission control section sequentially illuminates the light emitting elements is settable and changeable.

8. The performance apparatus as claimed in claim 7, wherein the moving velocity at which said light emission control section sequentially illuminates the light emitting elements is settable and changeable for each of the key switch rows.

9. The performance apparatus as claimed in claim 1, wherein, for each of the key switch rows, said light emission control section starts sequentially illuminating the light emitting elements of the key switch row at a time point when operation of any one of the key switches of the key switch row has been detected by said detection section.

10. A method of generating a tone with a performance apparatus that includes a plurality of key switches arranged in a plurality of key switch rows, and a plurality of light emitting elements provided in corresponding relation to the key switches, said method comprising:

a step of detecting an operated key switch for each of the key switch rows;

an illumination step of, on the basis of detection in the detecting step, sequentially illuminating the light emitting elements in such a manner that an illuminated position reciprocates between the operated key switch and the key switch located at a first predetermined position in the same key switch row of the operated key switch; and a tone generation step of generating at least one of tones allocated to the same key switch row of the operated key switch when the key switch located at a second predetermined position in the same key switch row of the operated key switch is illuminated.

11. The method as claimed in claim 10, wherein the key switch located at the first predetermined position is the key switch located at one end of the same key switch row of the operated key switch, and the key switch located at the second predetermined position is at least one of the key switch located at the one end of the same key switch row of the operated key switch or the operated key switch.

12. The method as claimed in claim 10, wherein tones are allocated to individual ones of the key switches, and said tone generation step generates the tone allocated to the operated key switch.

13. A computer-readable medium storing a computer program for controlling a performance apparatus that includes a plurality of key switches arranged in a plurality of key switch rows, and a plurality of light emitting elements provided in corresponding relation to the key switches, the program including:

a detecting instruction for detecting an operated key switch for each of the key switch rows;

an illumination instruction for, on the basis of the detection made in the detecting instruction, sequentially illuminating the light emitting elements in such a manner that an illuminated position reciprocates between the operated key switch and the key switch located at a first predetermined position in the same key switch row of the operated key switch; and a tone generation instruction for generating at least one of tones allocated to the same key switch row of the operated key switch when the key switch located at a second predetermined position in the same key switch row of the operated key switch row is illuminated.

14. The computer-readable medium as claimed in claim 13, wherein the key switch located at the first predetermined position is the key switch located at one end of the same key switch row of the operated key switch, and the key switch located at the second predetermined position is at least one of the key switch located at the one end of the same key switch row of the operated key switch or the operated key.

15. The computer-readable medium as claimed in claim 13, wherein tones are allocated to individual ones of the key switches, and the tone generation instruction instructs to generate the tone allocated to the operated key switch.

16. A performance apparatus comprising:

a plurality of key switches provided at a plurality of predetermined positions;

a plurality of light emitting elements provided in corresponding relation to the positions where said plurality of key switches are provided;

a detection section that detects duration of operation of a key switch having being operated among said plurality of key switches;

a light emission control section that, in accordance with the duration of operation detected by said detection section, controls light emission of the light emitting elements located in a predetermined key-switch-arranged range including the operated key switch; and a tone generation section that generates a tone, corresponding to the operated key switch, after imparting the tone with an effect corresponding to the detected duration of operation, wherein when the duration of operation detected by said detection section is greater than a predetermined time, said light emission control section controls light emission of two or more of said light emitting elements, located in the predetermined key-switch-arranged range including the operated key switch, in accordance with a predetermined pattern, and wherein said pattern includes switching of the light emitting element to be illuminated from one light emitting element to another in accordance with passage of time.

17. A method of controlling a performance apparatus that includes a plurality of key switches provided at a plurality of predetermined positions, a plurality of light emitting elements provided in corresponding relation to the positions where the plurality of key switches are provided, the method comprising the steps of:

detecting duration of operation of a key switch having being operated among the plurality of key switches;

controlling light emission of the light emitting elements, located in a predetermined key-switch-arranged range including the operated key switch, in accordance with the detected duration of operation; and generating a tone, corresponding to the operated key switch, after imparting the tone with an effect corresponding to the detected duration of operation, wherein when the detected duration of operation is greater than a predetermined time, the light emission controlling step controls light emission of two or more of the light emitting elements, located in the predetermined key-switch-arranged range including the operated key switch, in accordance with a predetermined pattern, and wherein the pattern includes switching of the light emitting element to be illuminated from one light emitting element to another in accordance with passage of time.

18. A computer-readable medium storing a computer program for controlling a performance apparatus that includes a plurality of key switches provided at a plurality of predetermined positions, a plurality of light emitting elements provided in corresponding relation to the positions where the plurality of key switches are provided, the computer program containing instructions for:

detecting duration of operation of a key switch having being operated among the plurality of key switches;

controlling light emission of the light emitting elements, located in a predetermined key-switch-arranged range including the operated key switch, in accordance with the detected duration of operation; and generating a tone, corresponding to the operated key switch, after imparting the tone with an effect corresponding to the detected duration of operation, wherein when the detected duration of operation is greater than a predetermined time, the light emission controlling instruction controls light emission of two or more of the light emitting elements, located in the predetermined key-switch-arranged range including the operated key switch, in accordance with a predetermined pattern, and wherein the pattern includes switching of the light emitting element to be illuminated from one light emitting element to another in accordance with passage of time.

* * * * *

UNITED STATES PATENT AND TRADEMARK OFFICE

CERTIFICATE OF CORRECTION

PATENT NO. : 7,342,164 B2
APPLICATION NO. : 11/495467
DATED : March 11, 2008
INVENTOR(S) : Nishibori et al.

It is certified that error appears in the above-identified patent and that said Letters Patent is hereby corrected as shown below:

In Item 56, References Cited, in the "Other Publications" section, please correct the following:

Please delete:

"Office Action issued on Nov. 17, 2006 in Japanese Patent Application No. 2004-200689, from which the present application No. claims priority.", and insert in place thereof:

--Office Action issued on Nov. 17, 2006 in Japanese Patent Application No. 2004-200689, from which related co-pending U.S. Application No. 11/176,645 claims priority.--

Please delete:

"Office Action issued on Nov. 17, 2006 in Japanese Patent Application No. 2004-200690, from which the present application claims priority.", and insert in place thereof:

--Office Action issued on Nov. 17, 2006 in Japanese Patent Application No. 2004-200690, from which related co-pending U.S. Application No. 11/176,645 claims priority.--

Please delete:

""TENORI-ON" disclosed in "The World of Digital Stadium Curator", pp. 1-7, on the internet (www.nhk.or.jp/digista/lab/digista_ten/curator.html.), date: Mar 28, 2005.", and insert in place thereof:

--"TENORI-ON" disclosed in "The World of Digital Stadium Curator", pp. 1-7, on the internet (www.nhk.or.jp/digista/lab/digista_ten/curator.html.), date: May 28, 2005.--

UNITED STATES PATENT AND TRADEMARK OFFICE

CERTIFICATE OF CORRECTION

PATENT NO. : 7,342,164 B2
APPLICATION NO. : 11/495467
DATED : March 11, 2008
INVENTOR(S) : Nishibori et al.

It is certified that error appears in the above-identified patent and that said Letters Patent is hereby corrected as shown below:

In Item 56, References Cited, in the "Other Publications" section, please correct the following:

Please delete:

"Extended European search report issued November 13, 2007 in corresponding European patent application EP07103475.5, pp. 1-14. This European application corresponds to related co-pending application No. 11/681,866.", and insert in place thereof:

--Extended European search report issued November 13, 2007 in corresponding European patent application EP07103475.5, pp. 1-14. This European application corresponds to related co-pending application No. 11/681,899.--

Signed and Sealed this

Fourteenth Day of October, 2008

JON W. DUDAS
*Director of the United States Patent and Trademark Office*